US010288392B2

(12) United States Patent
Haas

(10) Patent No.: US 10,288,392 B2
(45) Date of Patent: May 14, 2019

(54) RETAINER FOR BROADHEAD BLADES

(71) Applicant: FeraDyne Outdoors, LLC, Superior, WI (US)

(72) Inventor: Matthew Peter Haas, Duluth, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 0 days.

(21) Appl. No.: 15/900,429

(22) Filed: Feb. 20, 2018

(65) Prior Publication Data

US 2018/0245892 A1 Aug. 30, 2018

Related U.S. Application Data

(60) Provisional application No. 62/464,558, filed on Feb. 28, 2017.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 4,166,619 A * 9/1979 Bergmann ..... F42B 12/362 30/161
4,976,443 A * 12/1990 DeLucia ..... F42B 6/08 473/583
5,178,398 A * 1/1993 Eddy ..... F42B 6/08 473/583
5,458,341 A * 10/1995 Forrest ..... F42B 6/08 473/583
5,564,713 A * 10/1996 Mizek ..... F42B 6/08 473/583
5,803,844 A * 9/1998 Anderson ..... F42B 6/08 473/583
5,820,498 A * 10/1998 Maleski ..... F42B 6/08 473/584
6,217,467 B1 * 4/2001 Maleski ..... F42B 6/08 473/583
6,287,223 B1 * 9/2001 Liechty, II ..... F42B 6/08 473/583
6,287,224 B1 * 9/2001 Liechty, II ..... F42B 6/08 473/583
6,517,454 B2 * 2/2003 Barrie ..... F42B 6/08 473/583
6,910,979 B2 * 6/2005 Barrie ..... F42B 6/08 473/583
6,935,976 B1 * 8/2005 Grace, Jr. ..... F42B 6/08 473/583
7,234,220 B1 * 6/2007 Grace, Jr. ..... F42B 6/08 29/428
7,771,298 B2 * 8/2010 Pulkrabek ..... F42B 6/08 473/583

(Continued)

*Primary Examiner* — Alexander R Niconovich
(74) *Attorney, Agent, or Firm* — Winthrop & Weinstine, P.A.; Dipak J. Shah

(57) ABSTRACT

A broadhead having a ferrule, an elastic collar, and a plurality of blades pivotally coupled to the ferrule. A first biasing force exerted by the collar on each blade retains the blade in a retracted position, and a second biasing force exerted by the collar on each blade retains the blade in a first deployed position.

21 Claims, 7 Drawing Sheets

(56) References Cited

U.S. PATENT DOCUMENTS

| | | | | |
|---|---|---|---|---|
| RE44,144 | E * | 4/2013 | Barrie | 473/583 |
| 8,449,415 | B2 * | 5/2013 | Grace | F42B 6/08 473/583 |
| 8,684,869 | B1 * | 4/2014 | Perry | F42B 6/08 473/583 |
| 8,758,176 | B2 * | 6/2014 | Pedersen | F42B 6/08 473/583 |
| 8,905,874 | B2 * | 12/2014 | Sullivan | F42B 12/34 473/583 |
| 8,911,311 | B1 * | 12/2014 | Mizek | F42B 6/04 473/583 |
| 9,017,191 | B2 * | 4/2015 | Treto | F42B 6/08 473/583 |
| 9,028,349 | B2 * | 5/2015 | Budris | F42B 6/08 473/583 |
| 9,267,773 | B2 * | 2/2016 | Mizek | F42B 6/08 |
| 9,372,056 | B2 * | 6/2016 | Sullivan | F42B 6/08 |
| 9,945,648 | B2 * | 4/2018 | Grace | F42B 6/08 |
| 2012/0178560 | A1 * | 7/2012 | Grace | F42B 6/08 473/583 |
| 2017/0176154 | A1 * | 6/2017 | Haas | F42B 6/08 |
| 2018/0112956 | A1 * | 4/2018 | Haas | F42B 6/08 |

* cited by examiner

RETAINER FOR BROADHEAD BLADES

CROSS-REFERENCE TO RELATED APPLICATIONS

This application claims the benefit of U.S. Provisional Patent Application No. 62/464,558 filed Feb. 28, 2017, which is herein incorporated by reference in its entirety.

STATEMENT REGARDING FEDERALLY SPONSORED RESEARCH OR DEVELOPMENT

Not applicable.

TECHNICAL FIELD

The instant disclosure relates to broadheads. More particularly, the disclosure pertains to a collar for retaining the blades of a broadhead in a retracted position and in a deployed position.

BACKGROUND

Typical prior art broadheads utilize a collar for retaining the blades in a retracted or "closed" position during flight. The blades typically have a notch or a cut into which the collar is positioned for retaining the blades in the retracted position. Upon impacting a target, a force exerted on the blades shatters or breaks apart the collar releasing the blades. This then allows the blades, and the cutting edge in particular, to "open" into a swept-back or "laid back" position. Accordingly, the cutting edges form an obtuse angle relative to the longitudinal axis extending to the distal end or tip of the ferrule. Stated differently the cutting edges form an acute angle relative to the longitudinal axis extending to the proximal end of the ferrule or the shaft of the arrow. As such, the cutting radius of prior art broadheads is defined by the distance between the outermost end or tip of a cutting blade and the longitudinal axis of the ferrule.

Accordingly, there exists a need for increasing or maximizing the cutting radius of a broadhead.

SUMMARY

A non-limiting exemplary embodiment of a broadhead includes a ferrule, an elastic collar, and a plurality of blades pivotally coupled to the ferrule. Each blade includes a retention region and a deployment region. A first biasing force exerted by the collar on the retention region retains the blade in a retracted position, and a second biasing force exerted by the collar on the deployment region retains the blade in a first deployed position.

DETAILED DESCRIPTION

One or more non-limiting embodiments are described herein with reference to the accompanying drawings, wherein like numerals designate like elements. It should be clearly understood that there is no intent, implied or otherwise, to limit the disclosure in any way, shape or form to the embodiments illustrated and described herein. While multiple exemplary embodiments are provided, variations thereof will become apparent or obvious to a person of ordinary skills. Accordingly, any and all variants for providing functionalities similar to those described herein are considered as being within the metes and bounds of the instant disclosure.

Figure 1:
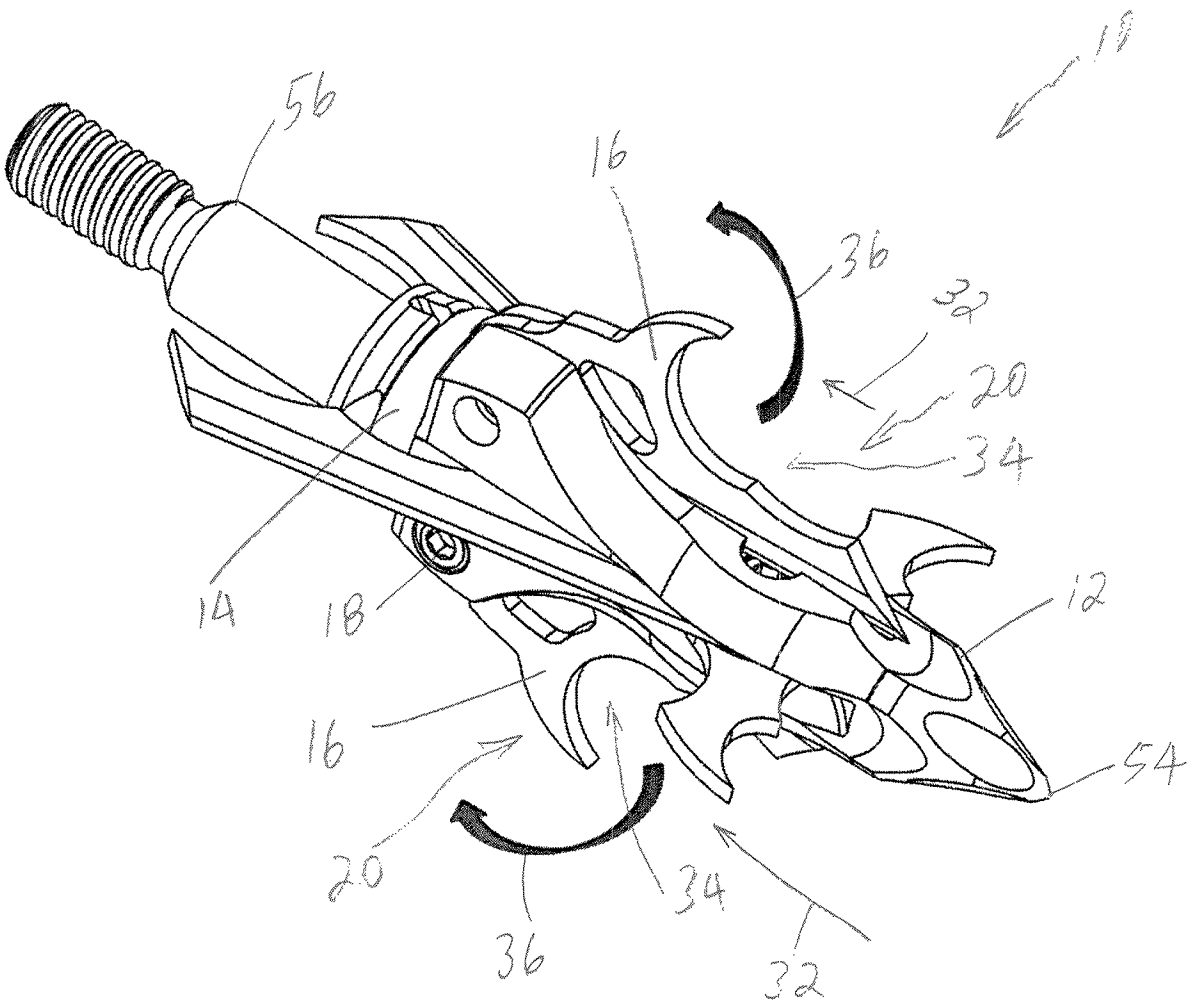
FIG. 1 is a perspective view of a non-limiting exemplary embodiment of a broadhead with a plurality of blades in a retracted position.
Figure 2:
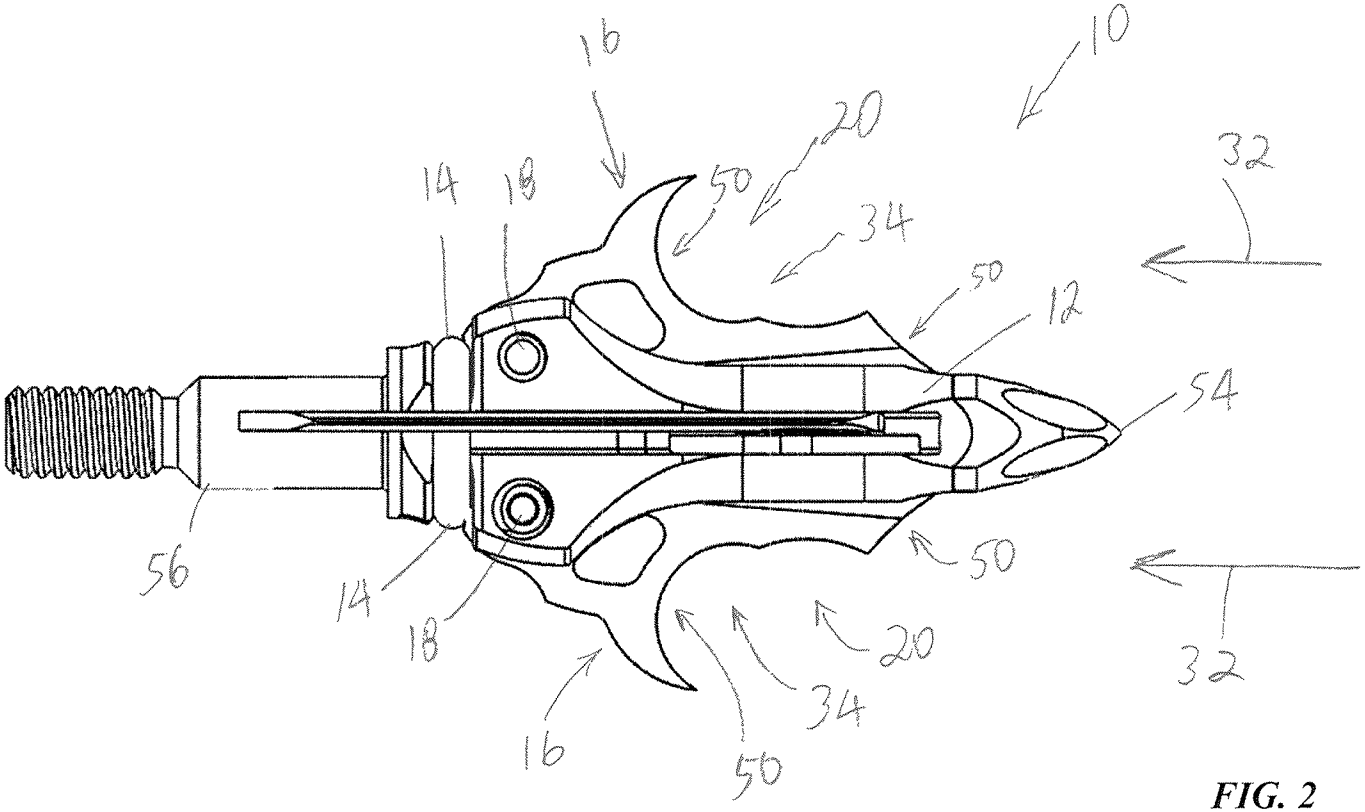
FIG. 2 is a plan view of the broadhead of FIG. 1.
Figure 3:
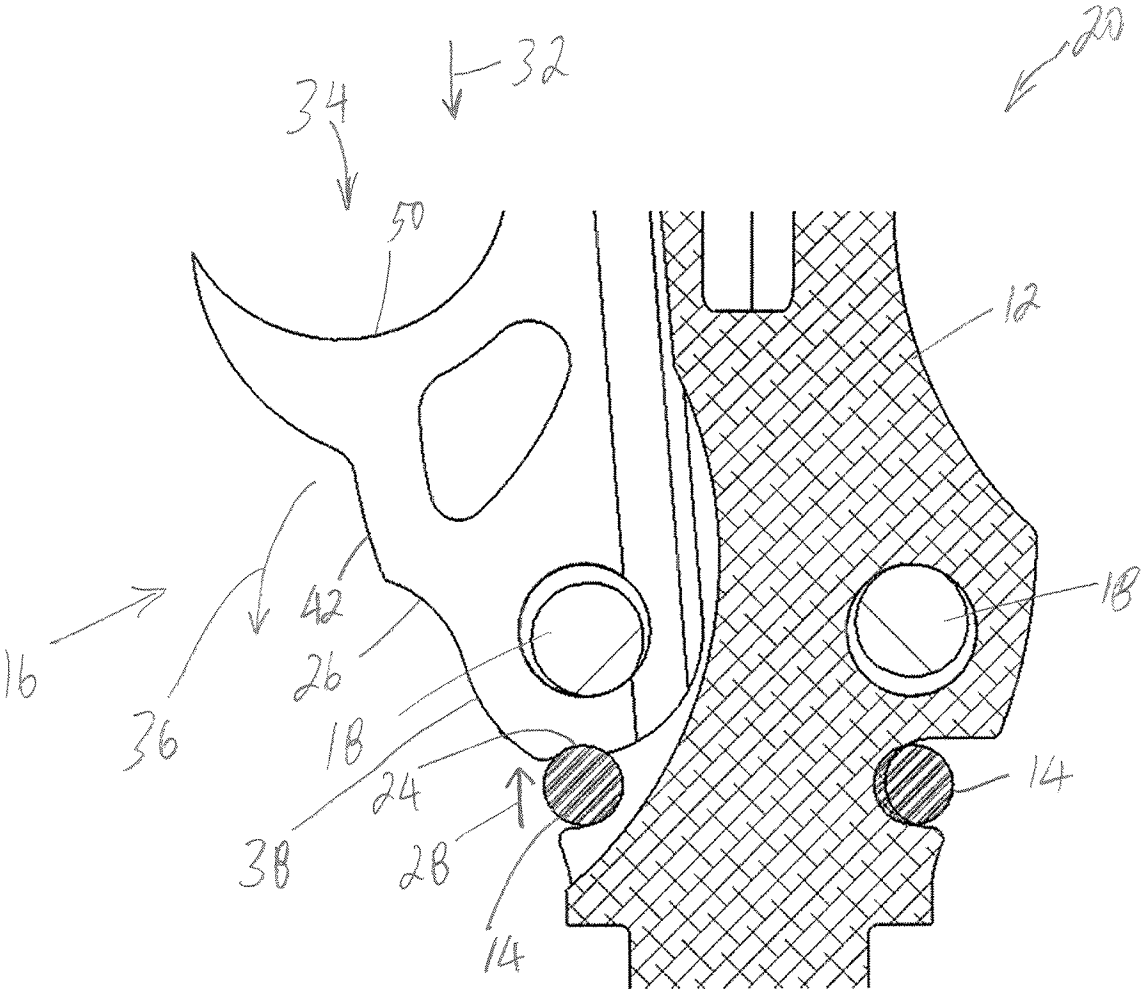
FIG. 3 is a cross-sectional view of a portion of the broadhead of FIG. 1 illustrating a blade in a retracted position.
Figure 4:
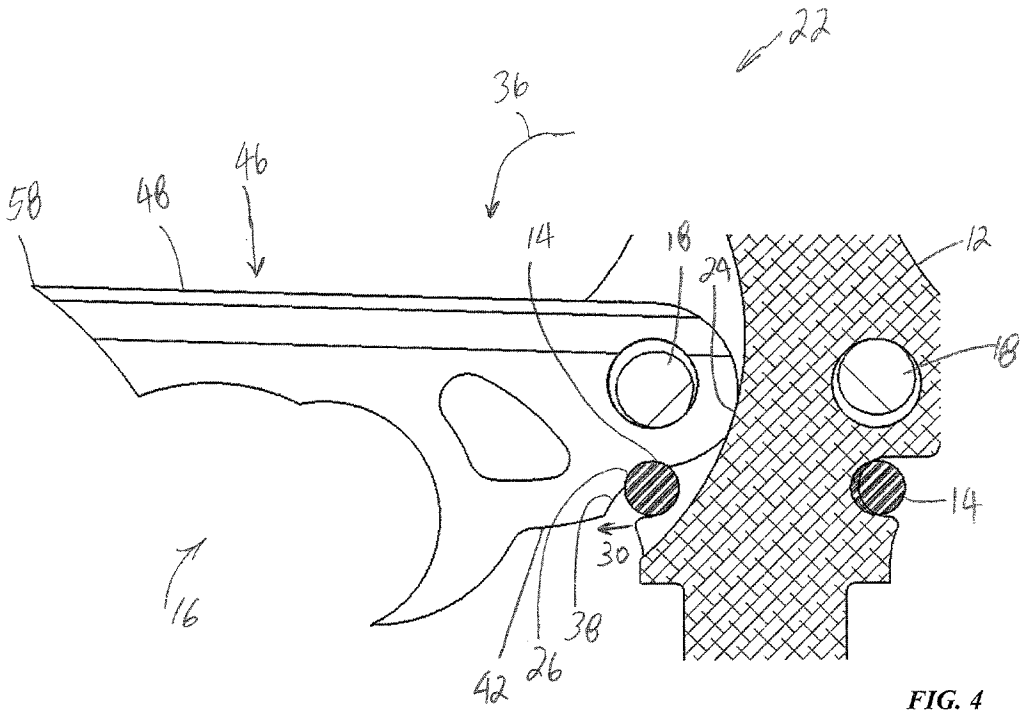
FIG. 4 is a cross-sectional view of the broadhead of FIG. 1 illustrating a blade in a first deployed position.

FIGS. 1 and 2, respectively, illustrate a perspective view and a plan view of a non-limiting exemplary embodiment of a broadhead 10 having a ferrule 12, an elastic collar 14, and a plurality of blades 16 pivotally coupled to the ferrule 12 at pivot points 18. In FIGS. 1 and 2, each blade 16 is shown retained or held in a retracted position 20 by the collar 14. FIGS. 3 and 4, respectively, are cross-sectional views of a portion of the broadhead 10 illustrating the blade 16 held or retained, by the collar 14, in the retracted position 20 and in a first deployed position 22. Each blade 16 includes a retention region 24 and a deployment region 26. In some non-limiting exemplary embodiments, each blade 16 is retained or held in the retracted position 20 by a first biasing force 28 exerted by the collar 14 on the retention region 24. It will be apparent to one skilled in the art that each blade 16 is held in the retracted position 20 during flight. In certain non-limiting exemplary embodiments, each blade 16 is retained or held in the first deployed position 22 by a second biasing force 30 exerted by the collar 14 on the deployment region 26.

In certain non-limiting exemplary embodiments, when the broadhead 10 with the blades 16 in the retracted position 20 impacts and starts penetrating a target, a force 32 is exerted on at least a portion 34 of each retracted blade 16. When the force 32 is greater than the first biasing force 28, each blade 16 pivots about respective pivot point 18 and is pivotally displaced from the retracted position 20 towards the first deployed position 22 as indicated by the directional arrows 36. In some embodiments, when the force 32 is greater than the first biasing force 28, each blade 16 is displaced from the retracted position 20 to the first deployed position 22. In certain embodiments, at least a portion of the collar 14 remains in contact with, and exerts a first deployment biasing force on a first deployment edge or surface 38 of each pivoting blade 16.

In some non-limiting exemplary embodiments, the first deployment edge or surface 38 is configured such that the first deployment biasing force exerted thereon displaces each blade 16 from the retracted position 20 to the first deployed position 22. In certain non-limiting exemplary embodiments, the first deployment edge or surface 38 is configured such that each blade 16 is displaced to the first deployed position 22 with or without any aid or assistance from the first deployment biasing force. In some non-limiting exemplary embodiments, the first deployment edge or surface 38 is configured as a camming edge or surface.

In some non-limiting exemplary embodiments, if the force 32 decreases after the displacement of the blade 16 from the retracted position 20 is initiated, the first deployment biasing force exerted on the first deployment edge or surface 38 will cause the blade 16 to return to the retracted position 20. In certain non-limiting exemplary embodiments, if the force 32 decreases after the displacement of the blade 16 from the retracted position 20 is initiated, the first deployment biasing force exerted on the first deployment edge or surface 38 will cause the blade 16 to pivot to the first deployed position 22.

In a non-limiting exemplary embodiment, each blade 16 includes a second deployed position 40. In some embodiments, when the force 32 is greater than the second biasing force 30, each blade 16 pivots about respective pivot point 18 and is pivotally displaced from the first deployed position 22 towards the second deployed position 40. In some embodiments, when the force 32 is greater than the second biasing force 30, each blade 16 is displaced from the first deployed position 22 to the second deployed position 40. In certain embodiments, at least a portion of the collar 14 remains in contact with, and exerts a second deployment biasing force on a second deployment edge or surface 42 of each pivoting blade 16.

In some non-limiting exemplary embodiments, the second deployment edge or surface 42 is configured such that the second deployment biasing force exerted thereon displaces each blade 16 from the first deployed position 22 to the second deployed position 40. In certain non-limiting exemplary embodiments, the second deployment edge or surface 42 is configured such that each blade 16 is displaced to the second deployed position 40 with or without any aid or assistance from the second deployment biasing force. In some non-limiting exemplary embodiments, the second deployment edge or surface 42 is configured as a camming edge or surface.

In some non-limiting exemplary embodiments, if the force 32 decreases after the displacement of the blade 16 from the first deployed position 22 is initiated, the second deployment biasing force exerted on the second deployment edge or surface 42 will cause the blade 16 to return to the first deployed position 22. In certain non-limiting exemplary embodiments, if the force 32 decreases after the displacement of the blade 16 from the first deployed position 22 is initiated, the second deployment biasing force exerted on the second deployment edge or surface 42 will cause the blade 16 to pivot to the second deployed position 40.

In a non-limiting exemplary embodiment, if the collar 14 ruptures after the broadhead 10 impacts the target, each blade 16 will be pivotally displaced to the second deployed position 40. It will be apparent to one skilled in the art that each blade 16 will displace to the second deployed position 40 no matter where or how the blade 16 is positioned at the instant when the collar 14 ruptures. The deployment to the second deployed position 40 after the collar 14 ruptures can be from the retracted position 20 or from any location or position between the retracted position 20 and the second deployed position 40.

In a non-limiting exemplary embodiment wherein the collar 14 is intact, i.e., has not ruptured, each blade 16 will be pivotally displaced to the second deployed position 40 when the force 32 is greater than both the first and the second biasing forces 28, 30. Such deployment to the second deployed position 40 can be from the retracted position 20 or from any location or position between the retracted position 20 and the second deployed position 40.

In a non-limiting exemplary embodiment, the ferrule 12 includes at least one recess 44 configured for housing at least a portion of one or more blades 16. In some embodiments, at least a portion of a leading edge 46 of each blade 16 is housed in at least a portion of the recess 44. In certain embodiments, at least a portion of the leading edge 46 is configured as a cutting edge 48. In some embodiments, such as that illustrated in FIG. 1 for example, at least a portion of the cutting edge 48 is housed within the recess 44. Consequently, at least a portion of the cutting edge 48 of each blade 16 will be exposed when the blade 16 starts being pivotally displaced from the retracted position 20.

In a non-limiting exemplary embodiment, each blade 16 includes one or more impact regions 50. In some embodiments, when the broadhead 10 starts penetrating the target with the blades 16 in the retracted position 20, at least a portion of the force 32 is exerted on at least a portion of the one or more impact regions 50. Consequently, each blade 16 will start being pivotally displaced from the retracted position 20, and at least a portion of the cutting edge 48 will be exposed. As such, at least a portion of the force 32 will be exerted on the exposed cutting edge 48 and/or on the cutting edge housed within the recess 44, which may assist in the deployment of the blade 16.

Figure 5:
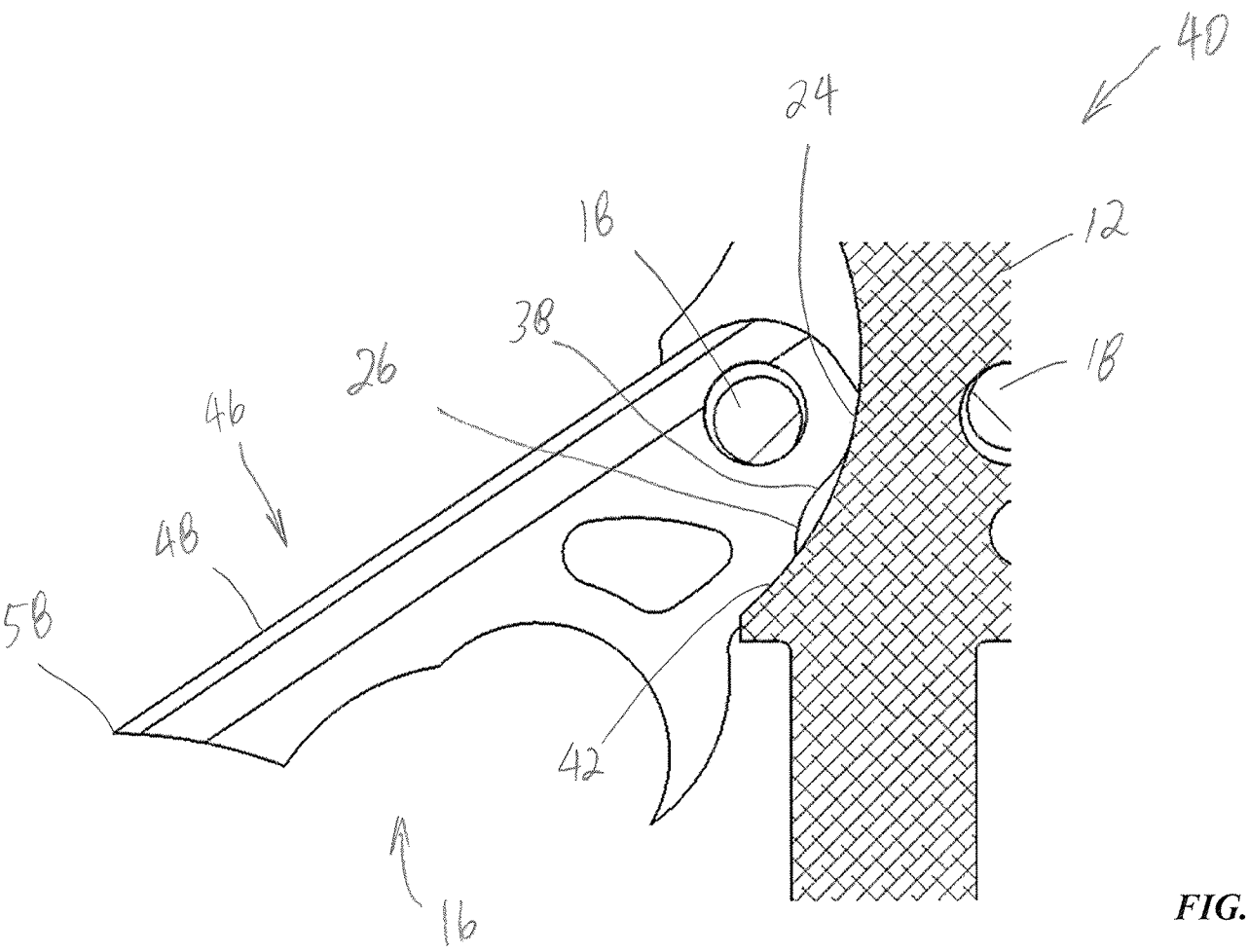
FIG. 5 is a cross-sectional view of the broadhead of FIG. 1 illustrating a blade in a second deployed position.
Figure 6:
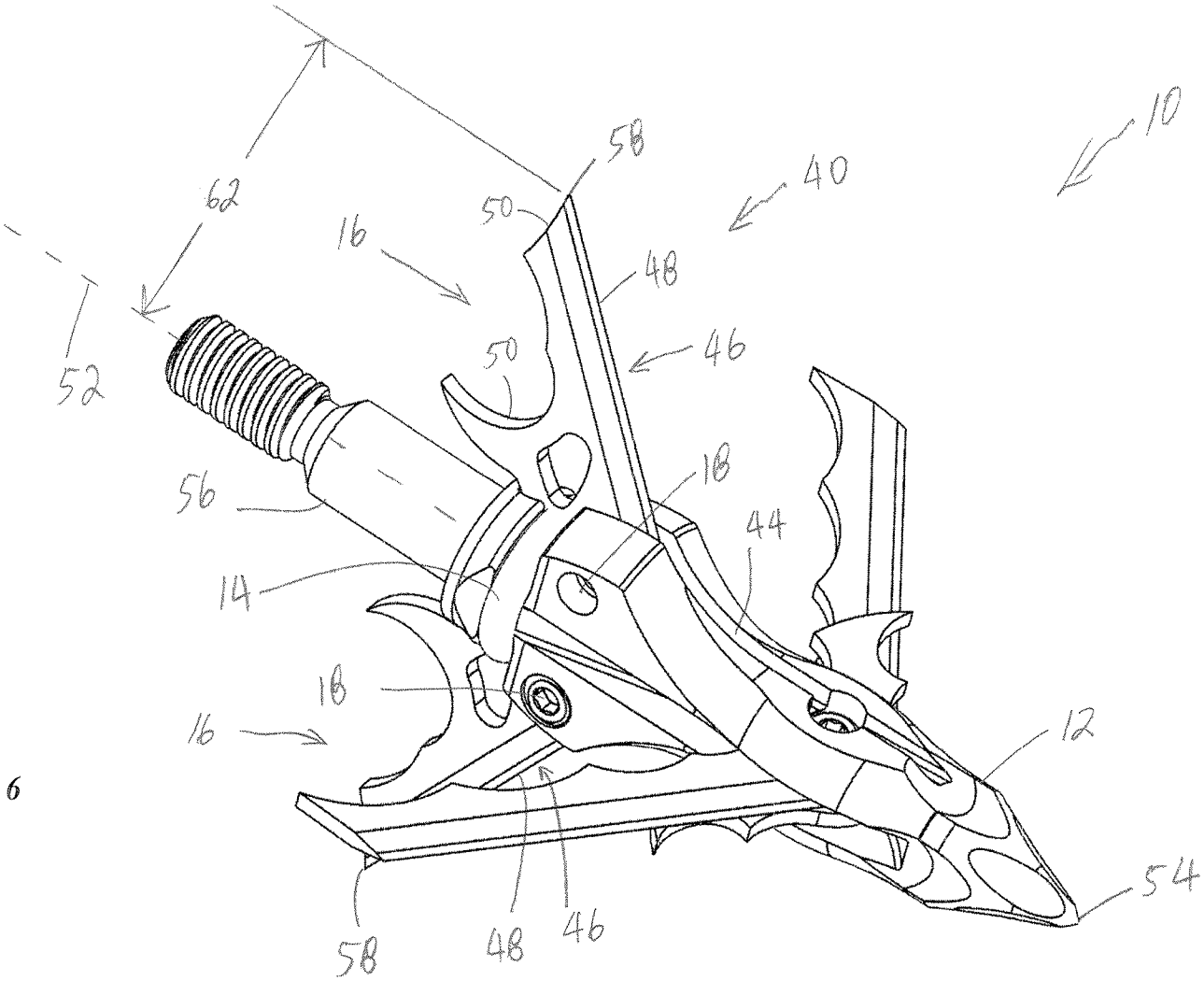
FIG. 6 illustrates the broadhead of FIG. 1 with the blades in a deployed position.
Figure 7:
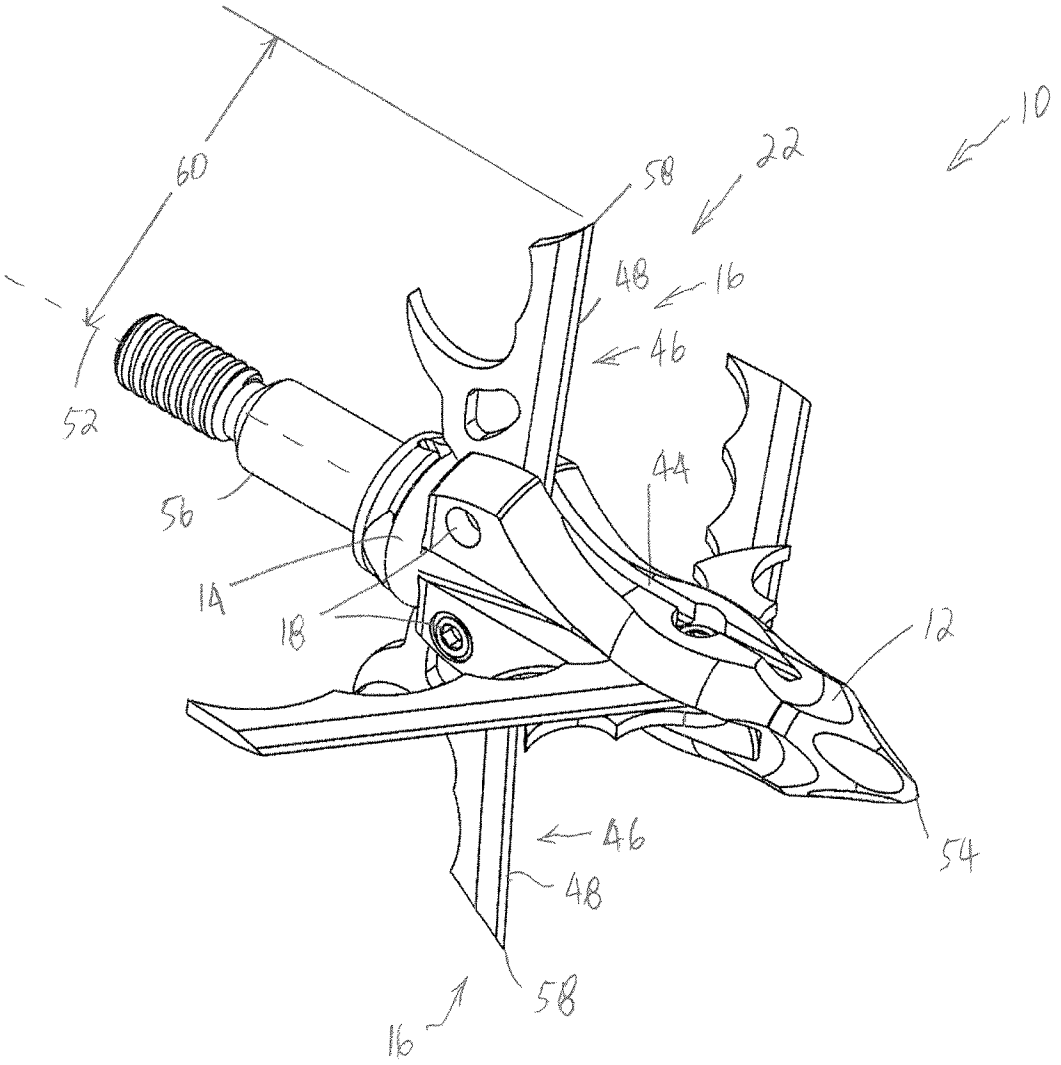
FIG. 7 illustrates the broadhead of FIG. 1 with the blades in another deployed position.

In some non-limiting exemplary embodiments, such as that illustrated in FIGS. 4 and 7 for example, each blade 16 will be substantially orthogonal to a longitudinal axis 52 of the ferrule 12 when in the first deployed position 22. Consequently, the cutting edges 48 also will be substantially orthogonal to the longitudinal axis 52. In certain non-limiting exemplary embodiments, such as that illustrated in FIGS. 5 and 6 for example, each blade 16 will be "fully opened" or "fully extended" into a "swept back" or "laid back" position when in the second deployed position 40. As such, when the blades 16 are in the second deployed position 40, the cutting edges 48 form an obtuse angle with the longitudinal axis 52 extending from the pivot points 18 to a distal end or tip 54 of the ferrule 12. Stated differently, when the blades 16 are in the second deployed position 40, the cutting edges 48 form an acute angle with the longitudinal axis 52 extending from the pivot points 18 to a proximal end 56 of the ferrule 12.

In a non-limiting exemplary embodiment, a "cutting radius" of each blade 16 will be defined by a distance between the longitudinal axis 52 of the ferrule 12 and an outermost tip 58 of the cutting edge 48 of each blade 16. FIGS. 6 and 7, respectively, illustrate non-limiting exemplary embodiments of the broadhead 10 with the blades 16 in the second and the first deployed positions 40, 22. As can be seen, a cutting radius 60 for the blades 16 in the first deployed position 22 will be greater than a cutting radius 62 for the blades 16 in the second deployed position 40. In some non-limiting exemplary embodiments, the cutting radius 60 is a maximum cutting radius of the broadhead 10.

In view thereof, modified and/or alternate configurations of the embodiments described herein may become apparent or obvious to one of ordinary skill. All such variations are considered as being within the metes and bounds of the instant disclosure. For instance, while reference may have been made to particular feature(s) and/or function(s), the disclosure is considered to also include embodiments configured for functioning and/or providing functionalities similar to those disclosed herein with reference to the accompanying drawings. Accordingly, the spirit, scope and intent of the instant disclosure is to embrace all such variations. Consequently, the metes and bounds of the disclosure is solely defined by the appended claims and any and all equivalents thereof.

What is claimed is:

1. A broadhead, comprising:

a ferrule;

an elastic collar; and a plurality of blades pivotally coupled to the ferrule, each blade comprising:

a retention region; and a deployment region defined at least in part by a first and a second deployment edge;

wherein, a first biasing force exerted by the collar on the retention region retains the blades in a retracted position;

a first deployment biasing force exerted by the collar on the first deployment edge retains the blades in a first deployed position; and a second deployment biasing force exerted by the collar on the second deployment edge retains the blades in a second deployed position.

2. The broadhead of claim 1, wherein each blade is displaced from the retracted position towards the first deployed position when a force exerted on at least a portion of the blade is greater than the first biasing force.

3. The broadhead of claim 2, wherein the blade is displaced towards the retracted position when the force decreases.

4. The broadhead of claim 2, wherein the blade is displaced to the first deployed position.

5. The broadhead of claim 4, wherein the blade is displaced towards the second deployed position when the force is greater than the first deployment biasing force.

6. The broadhead of claim 5, wherein the blade is displaced towards the first deployed position when the force decreases.

7. The broadhead of claim 5, wherein the blade is displaced to the second deployed position.

8. The broadhead of claim 7, wherein a cutting edge of the blade forms an obtuse angle with a longitudinal axis of the ferrule.

9. The broadhead of claim 5, wherein the blade is displaced towards the second deployed position when the force decreases.

10. The broadhead of claim 4, wherein a cutting edge of the blade is substantially orthogonal to a longitudinal axis of the ferrule.

11. The broadhead of claim 2, wherein:

each blade comprises an impact region; and at least a portion of the force is exerted on at least a portion of the impact region.

12. The broadhead of claim 2, wherein displacement of the blade from the retracted position exposes at least a portion of a cutting edge of the blade.

13. The broadhead of claim 12, wherein at least a portion of the force is exerted on at least a portion of the cutting edge of the blade.

14. The broadhead of claim 2, wherein the blade is displaced towards the first deployed position when the force decreases.

15. The broadhead of claim 1, wherein the ferrule comprises as least one recess configured for housing at least a portion of one or more blades.

16. The broadhead of claim 15, wherein each blade comprises a leading edge having at least a portion thereof housed in at least a portion of the at least one recess.

17. The broadhead of claim 16, wherein at least a portion of the leading edge is configured as a cutting edge;

at least a portion of the cutting edge is housed within the recess; and displacement of the blade from the retracted position exposes at least a portion of the cutting edge.

18. The broadhead of claim 1, wherein each blade is displaced towards the second deployed position when the collar ruptures after the broadhead impacts a target.

19. The broadhead of claim 1, wherein each blade is displaced towards the second deployed position when a force exerted on at least a portion of the blade is greater than the first and the second deployment biasing forces.

20. The broadhead of claim 1, wherein a cutting radius of each blade is defined at least in part by a distance between a longitudinal axis of the ferrule and an outermost tip of the blade.

21. The broadhead of claim 20, wherein the cutting radius of each blade in the first deployed position is greater than the cutting radius of each blade in the second deployed position.

* * * * *